US011549778B1

(12) United States Patent
Liu

(10) Patent No.: US 11,549,778 B1
(45) Date of Patent: Jan. 10, 2023

(54) ARROW PRESS DEVICE FOR CROSSBOWS

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 17/676,199

(22) Filed: Feb. 20, 2022

(51) Int. Cl.
*F41B 5/12* (2006.01)
*F41B 5/14* (2006.01)

(52) U.S. Cl.
CPC ..... *F41B 5/143* (2013.01); *F41B 5/12* (2013.01); *F41B 5/123* (2013.01)

(58) Field of Classification Search
CPC ..... F41B 5/12; F41B 5/123
See application file for complete search history.

(56) References Cited

U.S. PATENT DOCUMENTS 7,814,894 B2 * 10/2010 Giroux ..... F41B 5/1469 124/40
8,857,420 B2 * 10/2014 Grace ..... F41B 5/12 124/25
9,599,426 B2 * 3/2017 Darlington ..... F41B 5/12
9,726,454 B2 * 8/2017 McPherson ..... F41B 5/12

* cited by examiner

*Primary Examiner* — John A Ricci

(57) ABSTRACT

A crossbow includes a barrel with a groove in the top thereof. An aiming member is connected to the barrel. A rack is connected to the aiming member and located corresponding to the groove. A press piece includes a passage, a resilient member located in the passage and a press piece. The press piece is biased by the resilient member and partially protrudes beyond the press piece. Multiple restriction screws extend through the press piece and are threadedly connected to the rack. A spring is mounted to the threaded section of each restriction screw. The press piece is biased by the springs to resiliently contact the underside of the rack. An adjustment screw threadedly extends through the rack and contacts the press piece. The press piece is moved by rotating the adjustment screw to provide a constant force to the arrow in the groove.

7 Claims, 11 Drawing Sheets

ARROW PRESS DEVICE FOR CROSSBOWS

BACKGROUND OF THE INVENTION

1. Fields of the Invention

The present invention relates to a crossbow, and more particularly, to an arrow press device of a crossbow so as to constantly provide a pressing force to the arrow loaded in the groove of the crossbow.

2. Descriptions of Related Art

U.S. Pat. No. 9,417,029B1 discloses an arrow shaft pressing device for a crossbow and includes a sleeve connected to one end of the aiming device and has a passage with an aperture defined through the lower end of the sleeve. A shoulder is formed at the connection portion between the passage and the aperture. A pressing member has a flange and a shank extending from the underside of the flange. The pressing member is located in the passage of the sleeve and the distal end of the shank extends beyond the aperture. A restriction member is connected to the top end of the sleeve. A resilient member is biased between the flange of the pressing member and the restriction member. The distal end of the shank of the pressing member resiliently presses the arrow shaft.

The sleeve can be directly connected to a crossbow without removing any part of the crossbow. The distal end of the shank of the pressing member resiliently presses the arrow shaft to prevent the arrow from dropping from the groove of the crossbow.

It is noted that tem aiming device is fixedly connected to the crossbow so that the pressing member is located at a fixed position. When the arrow located in the groove has difference height relative to the pressing member, the pressing force to the arrow may vary. When the arrow is pressed hard by the pressing member, the speed that the arrow is shot is affected. In addition, the pressing force may also apply a force to the rear end of the arrow, so that the arrow is shot while the head of the arrow is pointed upward to loose its shooting precision.

The present invention intends to provide an arrow press device of a crossbow to eliminate the shortcomings mentioned above.

SUMMARY OF THE INVENTION

The present invention relates to a crossbow and comprises a barrel having a groove defined in the top thereof. An aiming member is connected to the barrel and located corresponding to the groove. A string is connected between two limbs of the crossbow. A rack is connected to the aiming member and located corresponding to the groove. A press piece includes a passage, a resilient member located in the passage and a press piece. The passage includes a bottom opening defined in the bottom thereof. A cap is connected to the top end of the passage. The resilient member is biased between the press piece and the underside of the cap so that the press piece partially protrudes beyond the bottom opening. Multiple restriction screws each have a threaded section and a head. A spring is mounted to the threaded section of each of the multiple restriction screws. The threaded section of each of the multiple restriction screws extends through the press piece and are threadedly connected to the underside of the rack. The press piece is biased by the springs to resiliently contact the underside of the rack. An adjustment screw threadedly extends through the rack and the distal end of the adjustment screw extends beyond the underside of the rack and is located corresponding to the press piece. The press piece is moved along the n axis of each of the restriction screws by rotating the adjustment screw.

The present invention also provides another crossbow and comprises a barrel having a groove defined in the top thereof. An aiming member is connected to the barrel and located corresponding to the groove. A string is connected between two limbs of the crossbow. A rack is connected to the aiming member and located corresponding to the groove. A fixing screw threadedly extends through the rack and includes a threaded section which partially protrudes beyond the rack and is located corresponding to the groove. A sleeve includes a recess defined axially in the underside thereof. The recess includes a bottom opening formed to the underside of the sleeve. A top threaded hole is defined axially in the top of the sleeve. A resilient member is located in the recess and biased between the inner top wall of the recess and a press piece which is located in the recess and partially protrudes beyond the bottom opening. The threaded section is threadedly connected to the top threaded hole. The sleeve is movable along the axis of the fixing screw by rotating the fixing screw.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
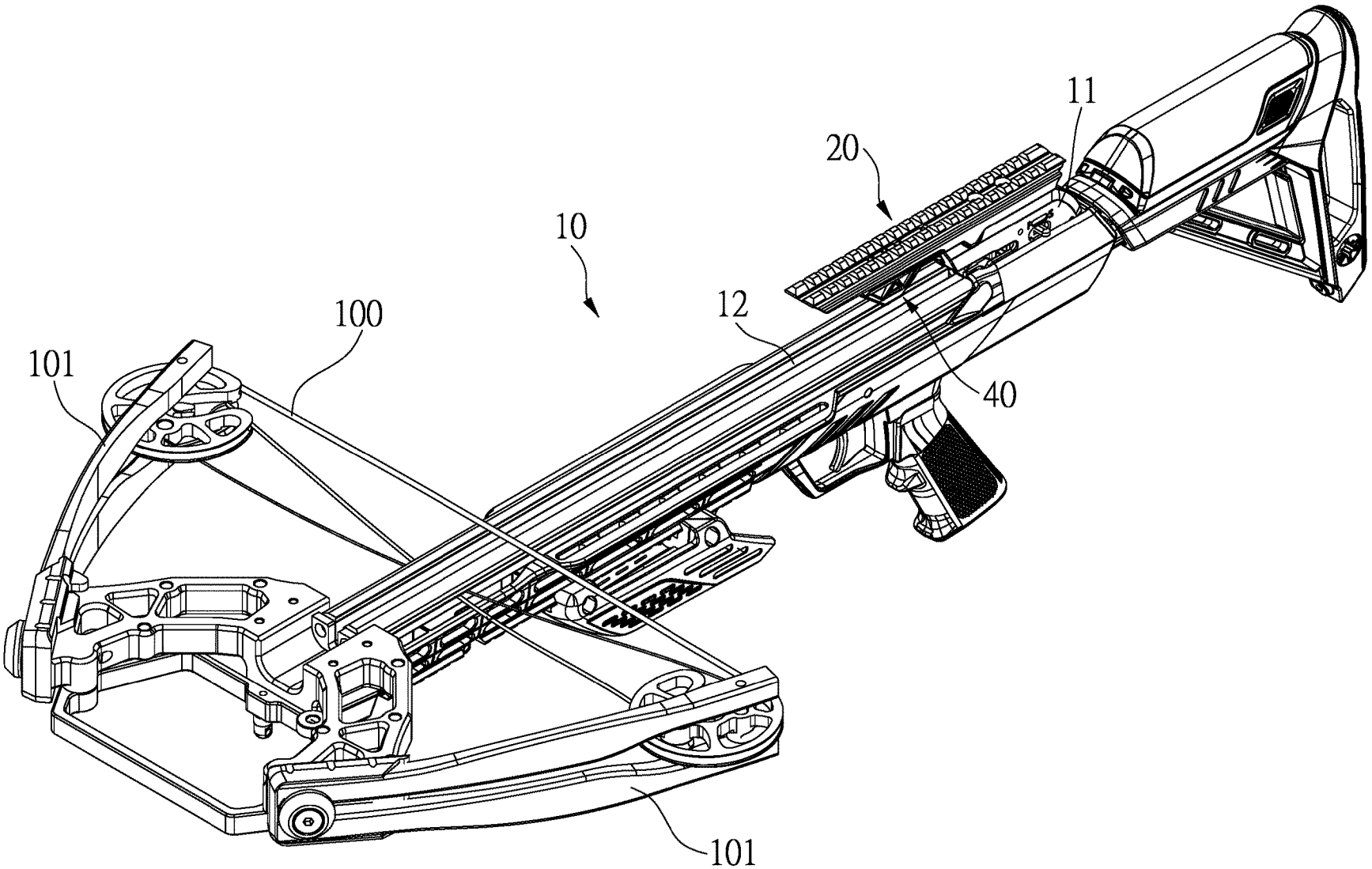
FIG. 1 is a perspective view to show the crossbow having the arrow press device of the present invention.

Referring to FIGS. 1 to 7, the first embodiment of the arrow press device of the present invention is equipped to a cross bow which comprises a barrel 10 having a groove 12 defined in the top thereof. An aiming member 11 is connected to the barrel 10 and located corresponding to the groove 12. A string 100 is connected between two limbs 101 of the crossbow. A rack 20 is connected to the aiming member 11 and located corresponding to the groove 12. A press piece 40 is connected to the underside of the rack 20 and includes a passage 41, a resilient member 42 located in the passage 41 and a press piece 43. The passage 41 includes a bottom opening 411 defined in the bottom thereof. A cap 412 is connected to the top end of the passage 41. The resilient member 42 is biased between the press piece 43 and the underside of the cap 412. The press piece 43 partially protrudes beyond the bottom opening 411.

Multiple restriction screws 30 each have a threaded section 31 and a head 32. A spring 33 is mounted to the threaded section 31 of each of the multiple restriction screws 30. The threaded section 31 of each of the multiple restriction screws 30 extends through the press piece 40 and is threadedly connected to the underside of the rack 20. The press piece 40 is biased by the springs 33 to resiliently contact the underside of the rack 20.

An adjustment screw 50 threadedly extends through the rack 20 and the distal end of the adjustment screw 50 extends beyond the underside of the rack 20 and is located corresponding to the press piece 40. The press piece 40 is moved along the axis of each of the restriction screws 30 by rotating the adjustment screw 50.

Figure 5:
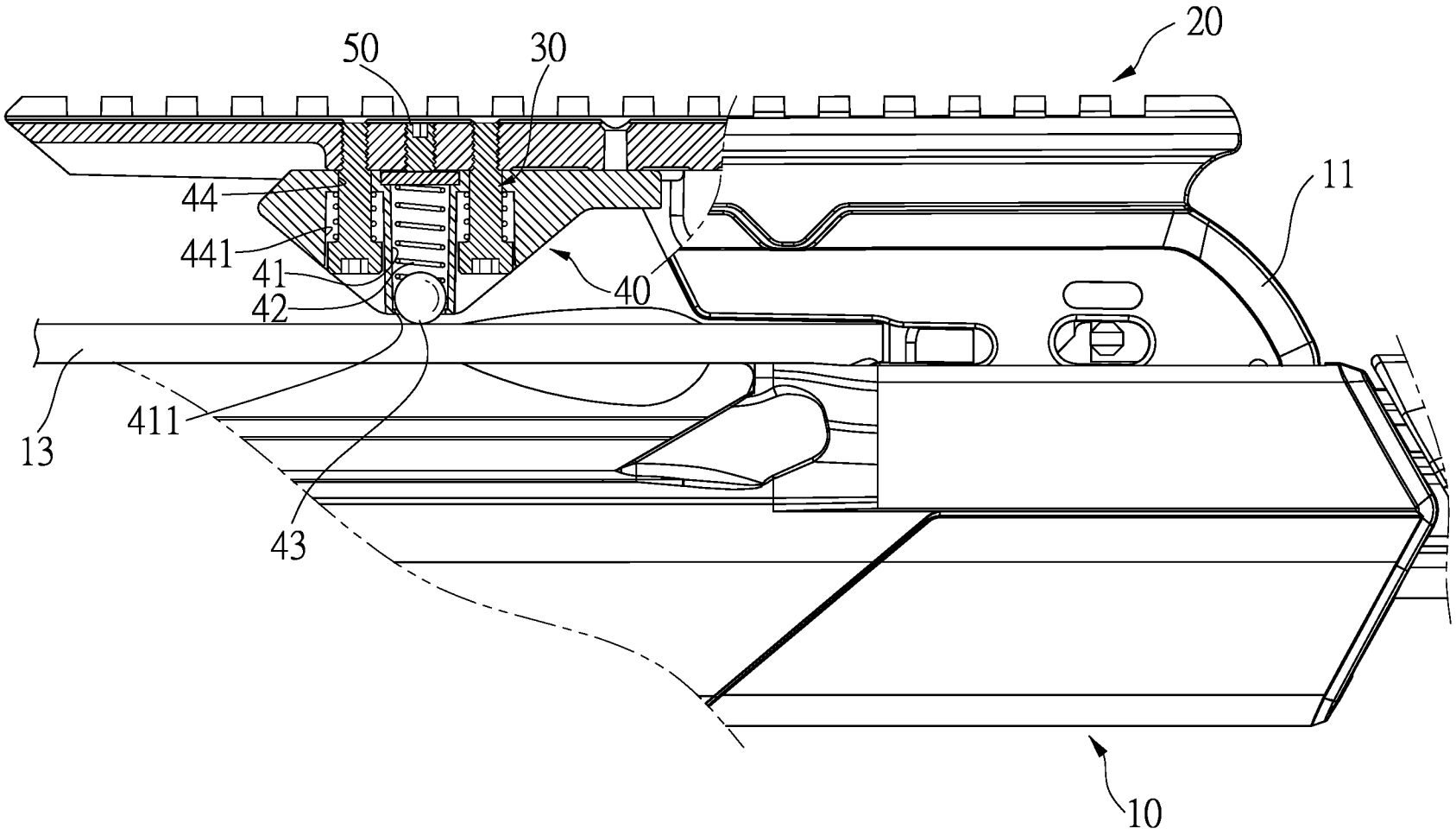
FIG. 5 is a partial cross sectional view of the arrow press device of the present invention wherein the arrow is pressed by the press piece.

As shown in FIG. 5, the press piece 40 is biased by the springs 33 so as to resiliently contact the underside of the rack 20. The press piece 43 is biased by the resilient member 42, and the press piece 43 is partially protrudes beyond the bottom opening 411 of the passage 41 and presses the arrow 13 in the groove 12.

Figure 6:
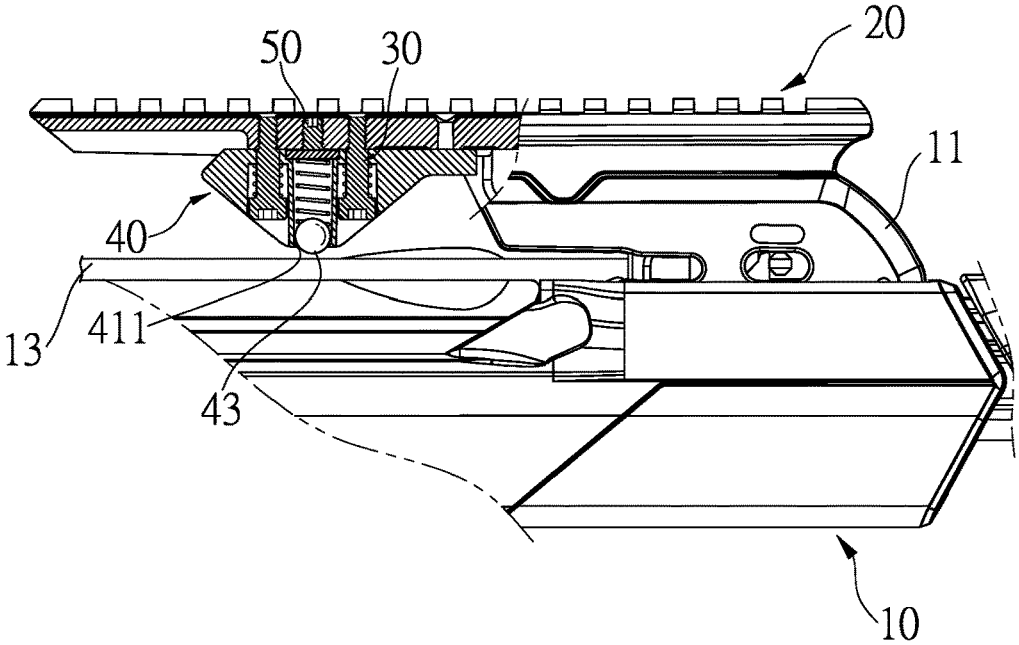
FIG. 6 shows that the press piece is not in contact with the arrow.
Figure 7:
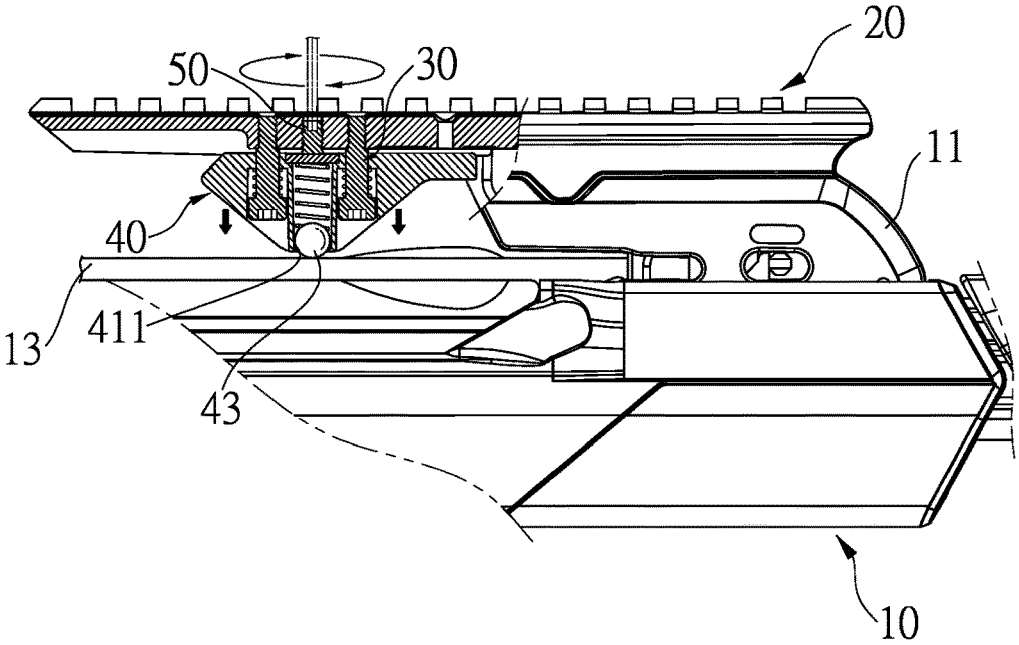
FIG. 7 shows that the press piece is lowered by rotating the adjustment screw.
Figure 8:
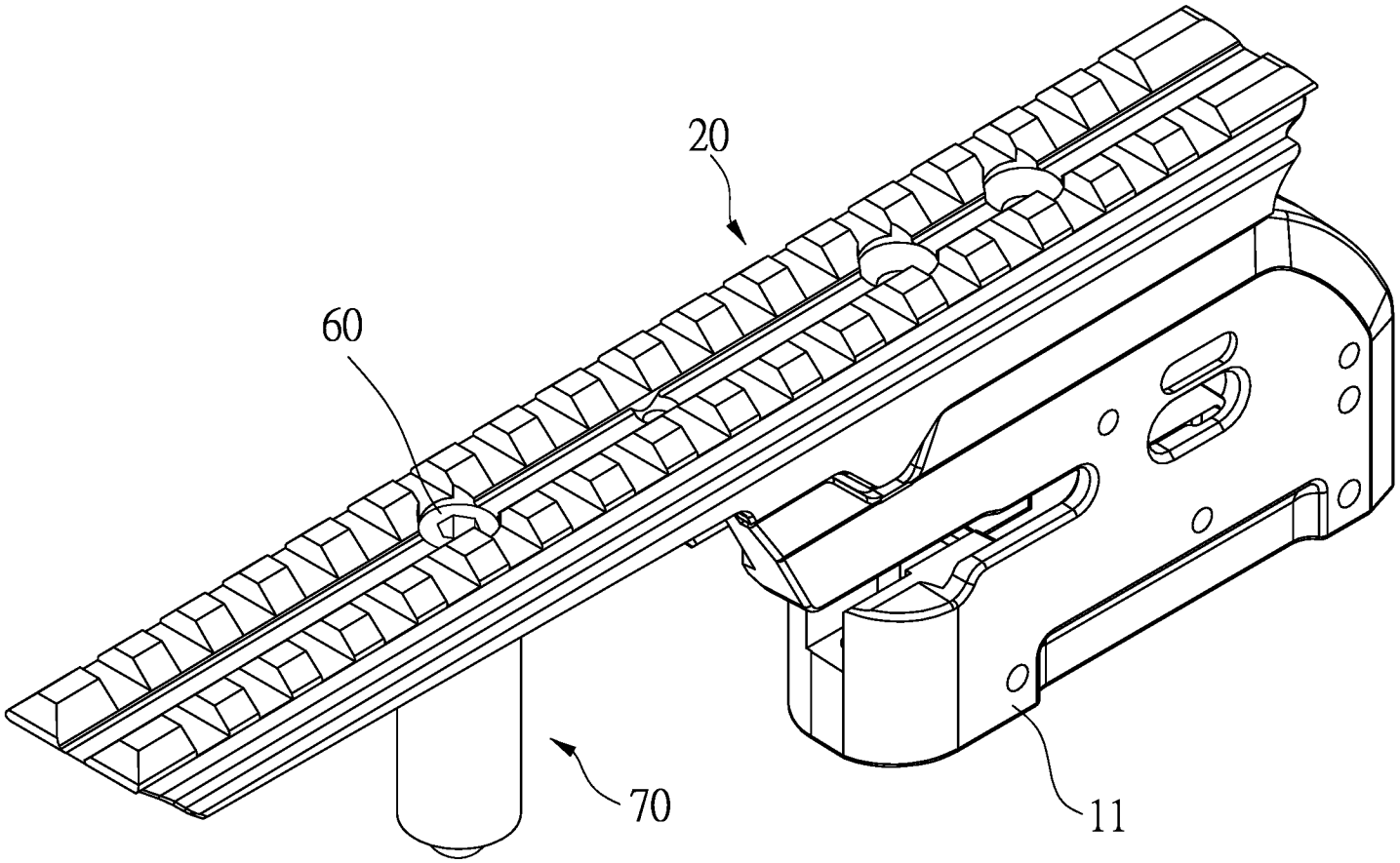
FIG. 8 shows the rack, the aiming member, the press piece and the adjustment screw of the second embodiment of the arrow press device of the present invention.
Figure 9:
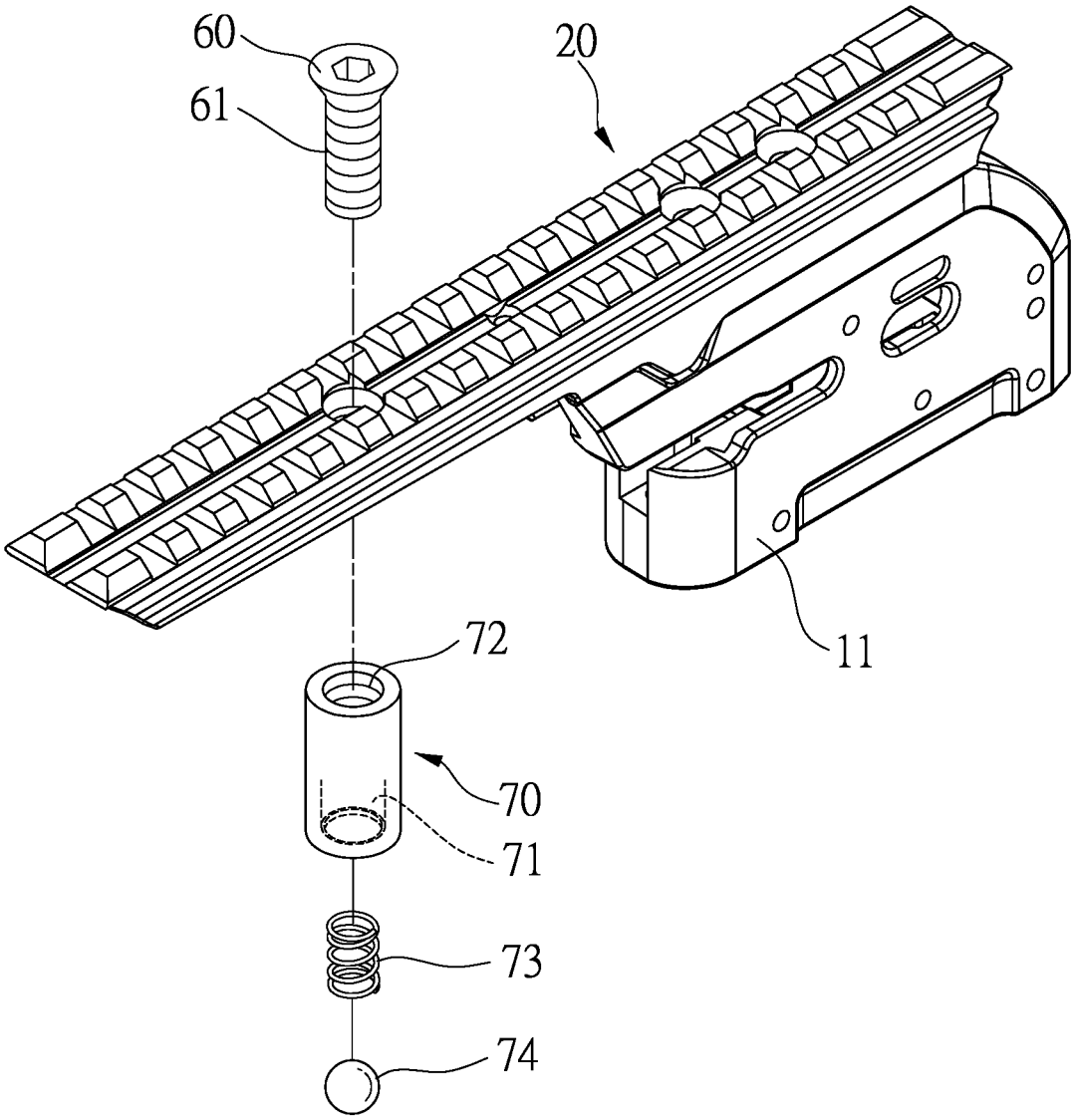
FIG. 9 is an exploded view of the second embodiment of the arrow press device of the present invention.
Figure 10:
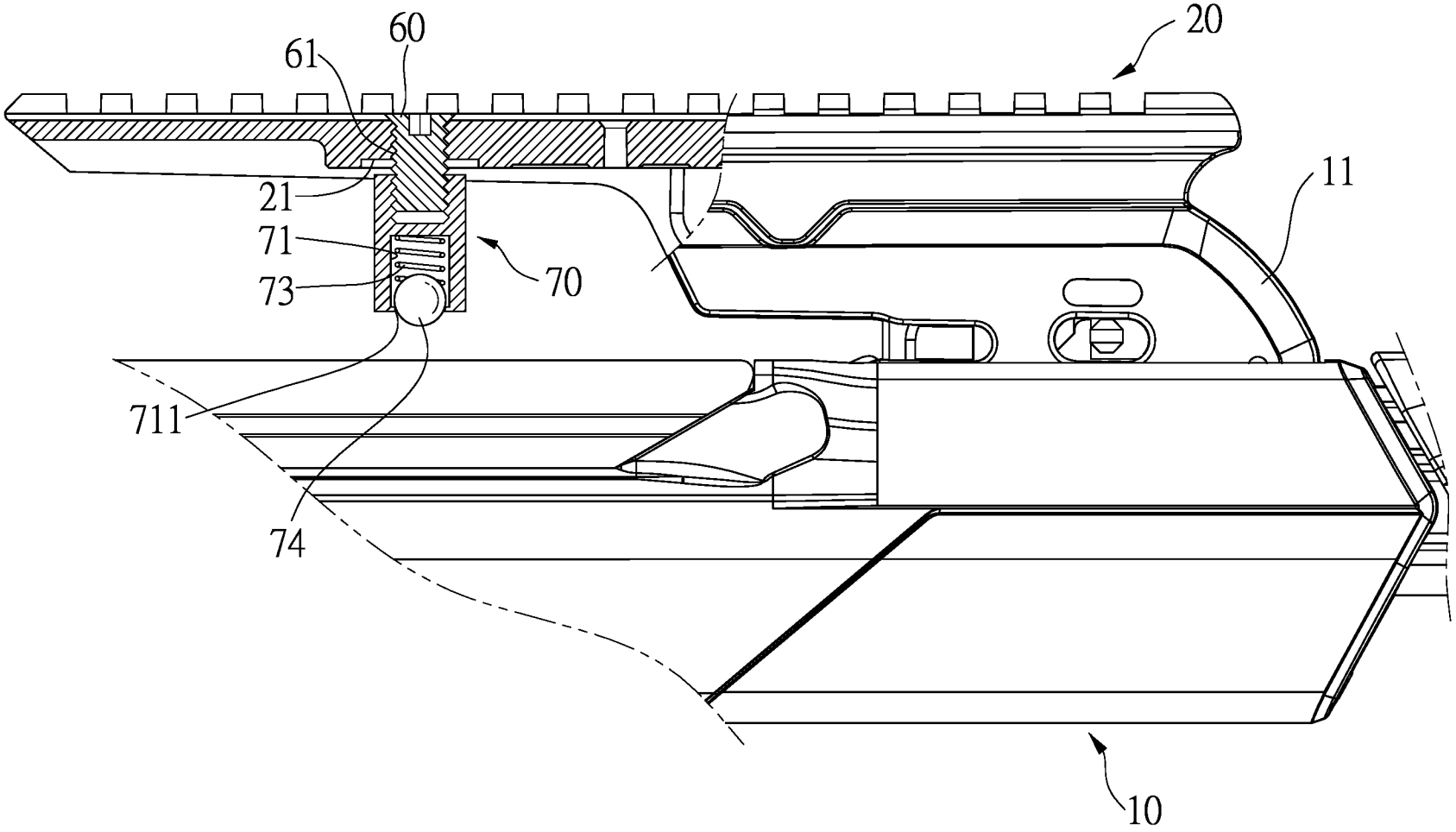
FIG. 10 is a partial cross sectional view of the arrow press device of the second embodiment of the present invention.

As shown in FIGS. 6 and 7, when there is a gap between the arrow 13 in the groove 12 and the press piece 43, as shown in FIG. 7, the user may rotate the adjustment screw 50 so that the distal end of the adjustment screw 50 that extends beyond the underside of the rack 20 can be lowered and moves the press piece 40 downward as shown by the arrows in FIG. 7 to allow the press piece 43 to press the arrow 13 in the groove 12.

In addition, because the distance between the cap 412 and the press piece 43 is not changed, so that the press piece 43 applies a constant force to the arrow 13. In other words, the movement of the press member 40 does not change the force that the press piece 43 applies the constant force to the arrow 13, so as to prevent the arrow 13 from being pressed by different forces.

Figure 2:
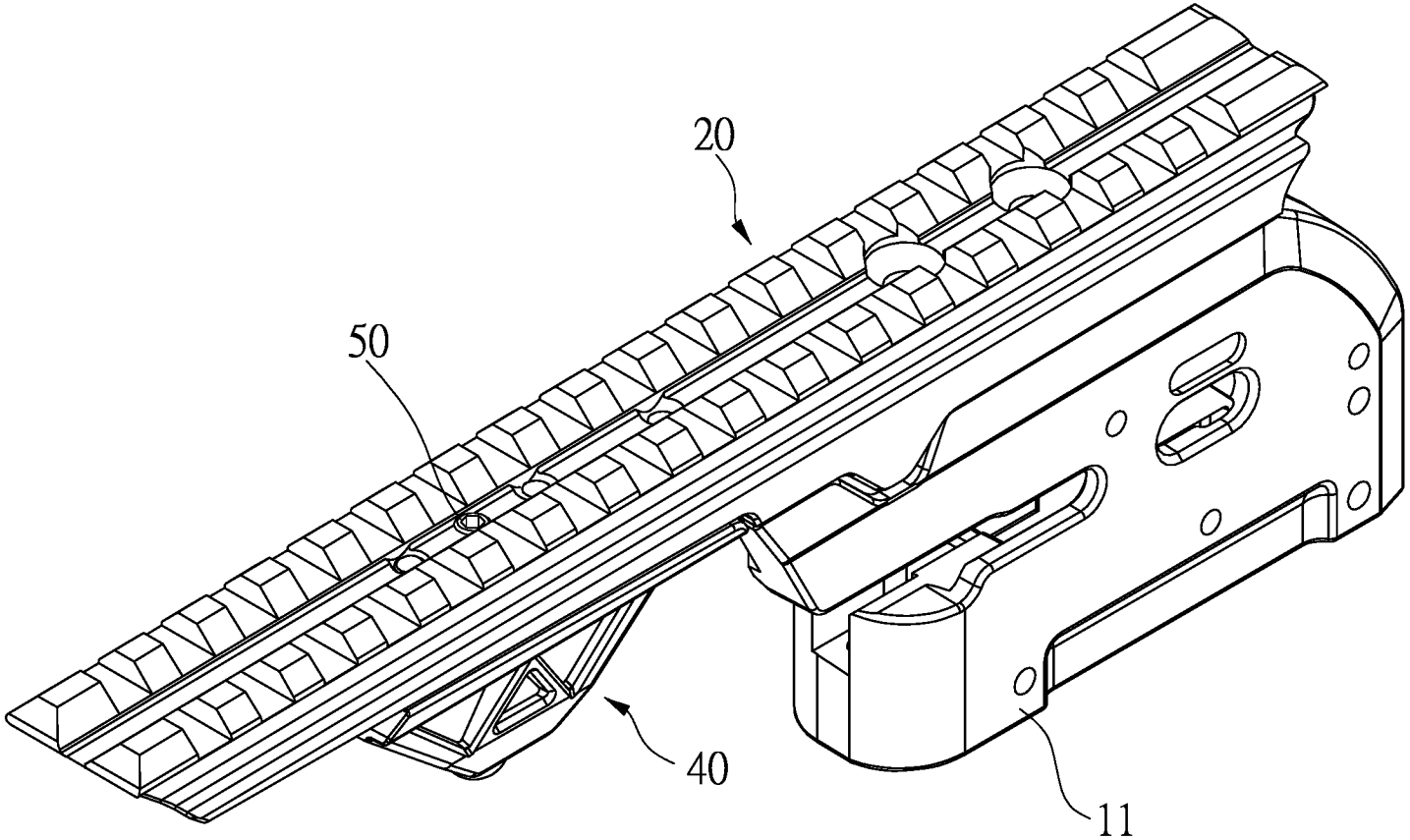
FIG. 2 shows the rack, the aiming member, the press piece and the adjustment screw of the arrow press device of the present invention.
Figure 3:
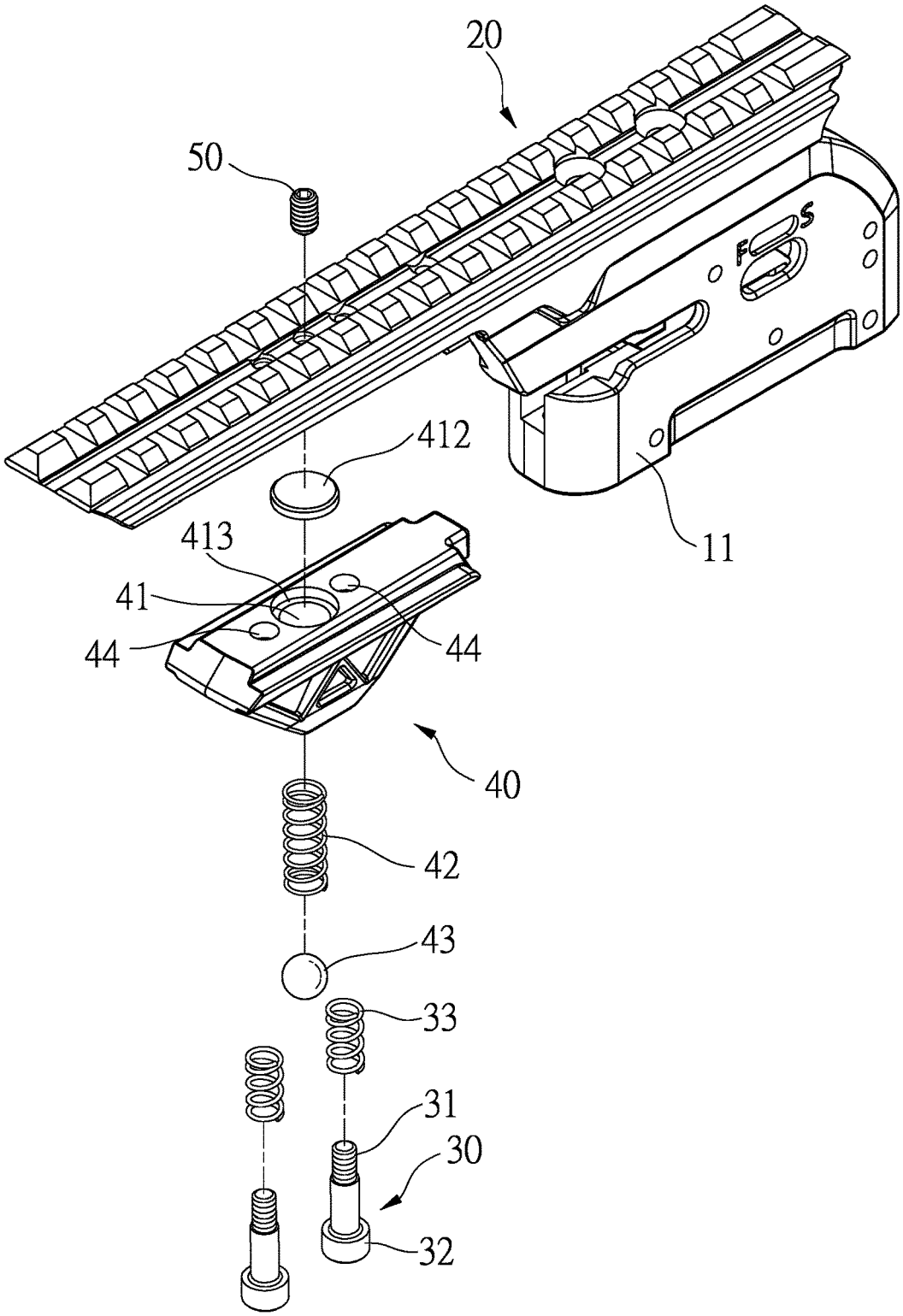
FIG. 3 is an exploded view of the arrow press device of the present invention.
Figure 4:
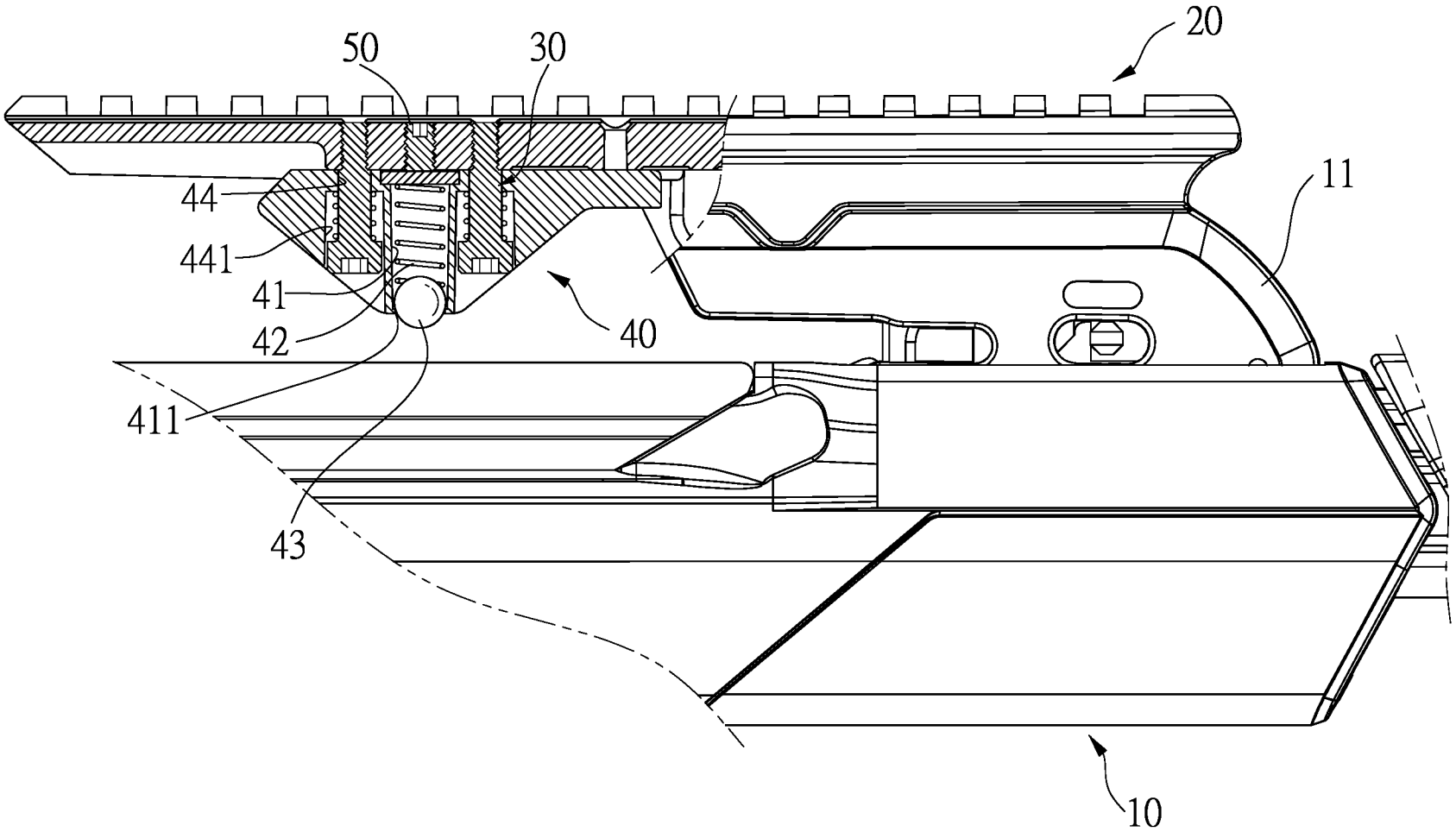
FIG. 4 is a partial cross sectional view of the arrow press device of the present invention.

As shown in FIGS. 1 and 2, the press piece 40 includes multiple bores 44, and the restriction screws 30 extend through the bores 44. Each bore 44 includes an enlarged-diameter section 441 in which the spring 33 corresponding to the bore 44 is located. When the press member 40 is moved along the axes of the restriction screws 30 by the adjustment screw 50, the enlarged-diameter section 441 accommodates the spring 33 to ensure that the spring 33 moves stably.

The passage 41 is located between the restriction screws 30, and includes a stepped recess 413 formed to the top end thereof so that the cap 412 is engaged with the stepped recess 413. In other words, by removing the cap 412 from the stepped recess 413, the resilient member 42 and the press piece 43 can be easily replaced via the top end of the passage 41.

The press piece 43 is a bead which can roll relative to the arrow 13 to reduce friction between the press piece 43 and the arrow 13.

FIGS. 8 to 13 show the second embodiment of the present invention, wherein the crossbow includes a barrel 10 having a groove 12 defined in the top thereof, and an aiming member 11 is connected to the barrel 10 and located corresponding to the groove 12. A string 100 is connected between two limbs 101 of the crossbow. A rack 20 is connected to the aiming member 11 and located corresponding to the groove 12. A fixing screw 60 threadedly extends through the rack 20, and includes a threaded section 61 which partially protrudes beyond the rack 20 and is located corresponding to the groove 12.

A sleeve 70 includes a recess 71 defined axially in the underside thereof. The recess 71 includes a bottom opening 711 formed to the underside of the sleeve 70. A top threaded hole 72 is defined axially in the top of the sleeve 70. A resilient member 73 is located in the recess 71 and biased between the inner top wall 712 of the recess 71 and a press piece 74 which is located in the recess 71 and partially protrudes beyond the bottom opening 711. The threaded section 61 is threadedly connected to the top threaded hole 72. The sleeve 70 is movable along the axial axis of the fixing screw 60 by rotating the sleeve 70.

Figure 11:
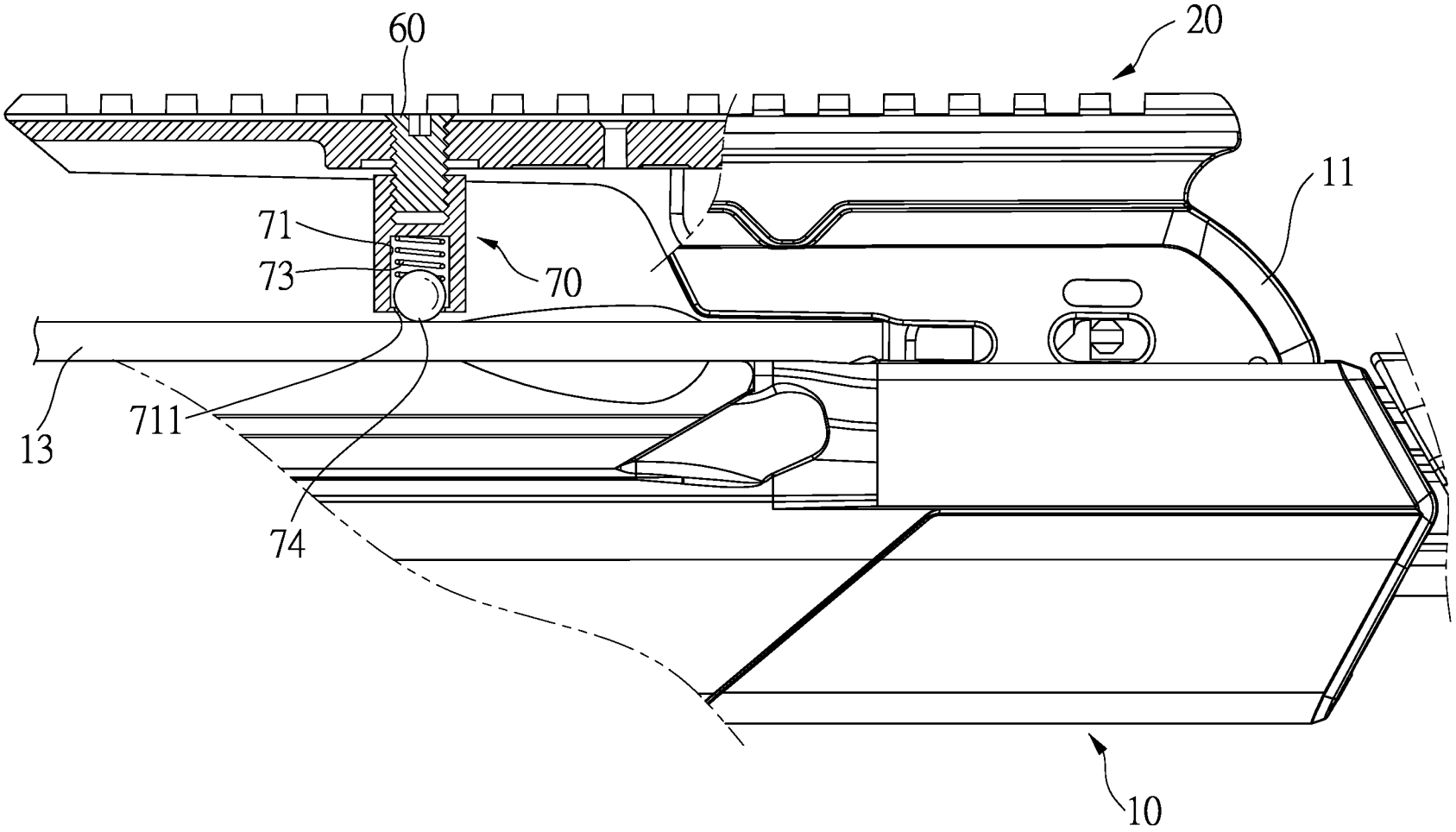
FIG. 11 is a partial cross sectional view of the arrow press device of the second embodiment of the present invention wherein the arrow is pressed by the press piece.

As shown in FIG. 11, the resilient member 73 in the recess 71 biases the press piece 74 which partially protrudes beyond the bottom opening 711 to press the arrow 13 in the groove 12.

Figure 12:
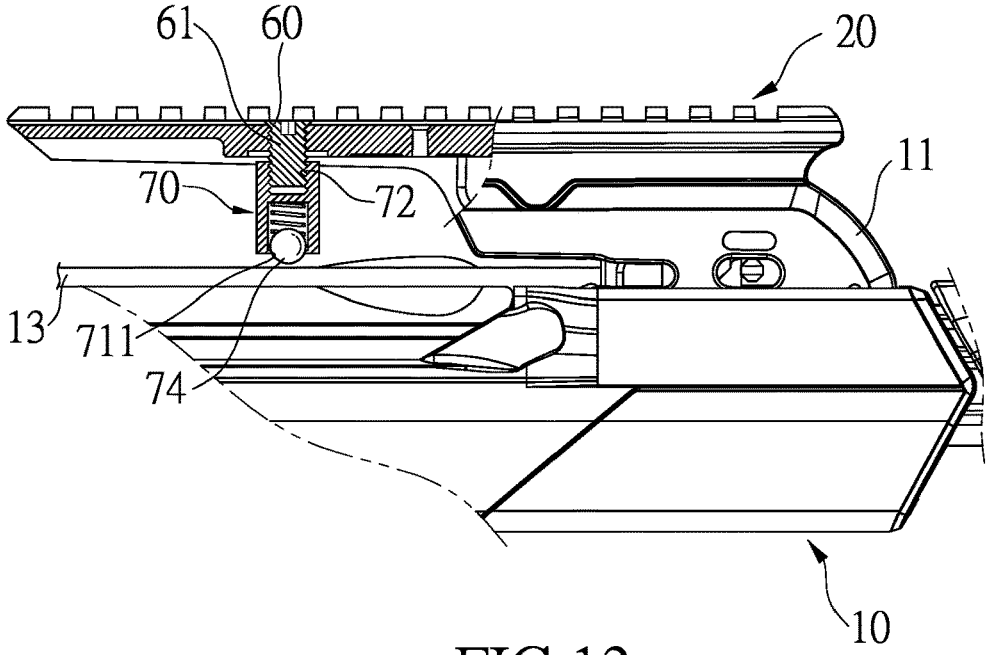
FIG. 12 shows that the press piece is not in contact with the arrow.
Figure 13:
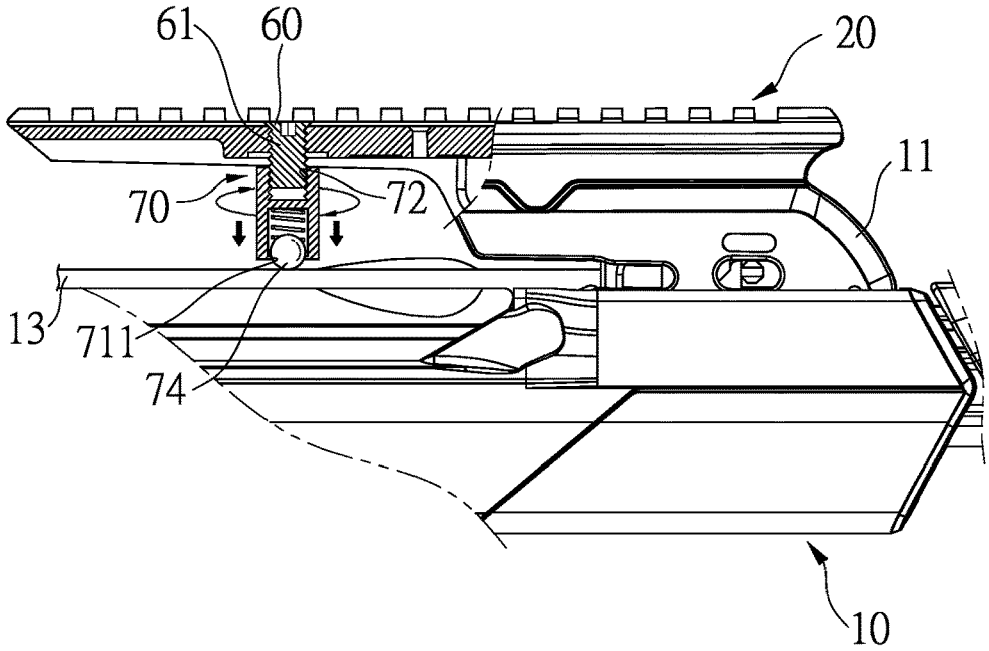
FIG. 13 shows that the press piece is lowered by rotating the sleeve.

As shown in FIGS. 12 and 13, when there is a gap between the arrow 13 in the groove 12 and the press piece 74, as shown in FIG. 13, the user may rotate the sleeve 70 so that the top threaded hole 72 of the sleeve 70 is threadedly moved along the threaded section 61 as shown in by the arrow heads in FIG. 13 to that the sleeve 70 can be lowered and the press piece 74 can press the arrow 13 in the groove 12.

Because the distance between inner top wall 712 of the recess 71 and the press piece 74 is not changed, so that the press piece 74 applies a constant force to the arrow 13 to prevent the arrow 13 from being pressed by different forces.

The rack 20 includes a recessed area 21 formed to the underside thereof. The threaded section 61 of the fixing screw 60 extends through the recessed area 21. The recessed area 21 faces the sleeve 70 and is sized to accommodate the top end of the sleeve 70. Therefore, the recessed area 21 provide an extra distance that the sleeve 70 can move during adjustment.

The press piece 74 is a bead which can roll relative to the arrow 13 to reduce friction between the press piece 74 and the arrow 13.

While we have shown and described the embodiment in accordance with the present invention, it should be clear to those skilled in the art that further embodiments may be made without departing from the scope of the present invention.

What is claimed is:

1. A crossbow comprising:

a barrel having a groove defined in a top thereof, an aiming member connected to the barrel and located corresponding to the groove, a string connected between two limbs of the crossbow;

a rack connected to the aiming member and located corresponding to the groove;

a press piece including a passage, a resilient member located in the passage and a press piece, the passage including a bottom opening defined in a bottom thereof, a cap connected to a top end of the passage, the resilient member biased between the press piece and an underside of the cap, the press piece partially protruding beyond the bottom opening;

multiple restriction screws each having a threaded section and a head, a spring mounted to the threaded section of each of the multiple restriction screws, the threaded section of each of the multiple restriction screws extending through the press piece and threadedly connected to an underside of the rack, the press piece being biased by the springs to resiliently contact the underside of the rack, and an adjustment screw threadedly extends through the rack and a distal end of the adjustment screw extending beyond the underside of the rack and located corresponding to the press piece, the press piece being moved along an axis of each of the restriction screws by rotating the adjustment screw.

2. The crossbow as claimed in claim 1, wherein the press piece includes multiple bores and the restriction screws extend through the bores, each bore includes an enlarged-diameter section in which the spring corresponding to the bore is located.

3. The crossbow as claimed in claim 1, wherein the passage is located between the restriction screws, the passage includes a stepped recess formed to the top end thereof and the cap is engaged with the stepped recess.

4. The crossbow as claimed in claim 1, wherein the press piece is a bead.

5. A crossbow comprising:

a barrel having a groove defined in a top thereof, an aiming member connected to the barrel and located corresponding to the groove, a string connected between two limbs of the crossbow;

a rack connected to the aiming member and located corresponding to the groove;

a fixing screw threadedly extending through the rack, the fixing screw including a threaded section which partially protrudes beyond the rack and located corresponding to the groove, and a sleeve having a recess defined axially in an underside thereof, the recess including a bottom opening formed to the underside of the sleeve, a top threaded hole defined axially in a top of the sleeve, a resilient member located in the recess and biased between an inner top wall of the recess and a press piece which is located in the recess and partially protrudes beyond the bottom opening, the threaded section threadedly connected to the top threaded hole, the sleeve being movable along an axis of the fixing screw 60 by rotating the sleeve.

6. The crossbow as claimed in claim 5, wherein the rack includes a recessed area formed to an underside thereof, the threaded section of the fixing screw extends through the recessed area, the recessed area faces the sleeve and is sized to accommodate a top end of the sleeve.

7. The crossbow as claimed in claim 5, wherein the press piece is a bead.

* * * * *